US010598435B2

(12) United States Patent
Lepez et al.

(10) Patent No.: US 10,598,435 B2
(45) Date of Patent: Mar. 24, 2020

(54) DEVICE FOR THE HEAT TREATMENT OF A PRODUCT

(71) Applicant: E.T.I.A.—EVALUATION TECHNOLOGIQUE, INGENIERIE ET APPLICATIONS, Compiegne (FR)

(72) Inventors: Olivier Lepez, Lamorlaye (FR); Philippe Sajet, Lacroiz Saint-Ouen (FR)

(73) Assignee: E.T.I.A.—EVALUATION TECHNOLOGIQUE, INGENIERIE ET APPLICATIONS, Compiegne (FR)

( * ) Notice: Subject to any disclaimer, the term of this patent is extended or adjusted under 35 U.S.C. 154(b) by 49 days.

(21) Appl. No.: 14/422,984

(22) PCT Filed: Sep. 2, 2013

(86) PCT No.: PCT/EP2013/068086
§ 371 (c)(1),
(2) Date: Feb. 20, 2015

(87) PCT Pub. No.: WO2014/044517
PCT Pub. Date: Mar. 27, 2014

(65) Prior Publication Data

US 2015/0204609 A1 Jul. 23, 2015

(30) Foreign Application Priority Data

Sep. 21, 2012 (FR) ..... 12 58889

(51) Int. Cl.
*F27B 9/24* (2006.01)
*F26B 23/06* (2006.01)
(Continued)

(52) U.S. Cl.
CPC ..... *F27B 9/24* (2013.01); *F26B 17/20* (2013.01); *F26B 23/06* (2013.01); *F27B 9/36* (2013.01);
(Continued)

(58) Field of Classification Search
CPC ..... F26B 17/20; F26B 2200/02; F26B 23/06; F27B 2009/2484; F27B 9/24; F27B 9/36; F27D 11/02
(Continued)

(56) References Cited

U.S. PATENT DOCUMENTS 1,685,226 A * 9/1928 Burdick ..... F27D 11/02 34/173
2,452,249 A * 10/1948 Leiske ..... F26B 17/20 34/183
(Continued)

FOREIGN PATENT DOCUMENTS

DE 42 20 143 A1 12/1993
EP 0 553 783 A1 8/1993
(Continued)

*Primary Examiner* — Lorne E Meade
*Assistant Examiner* — Ket D Dang
(74) *Attorney, Agent, or Firm* — Muncy, Geissler, Olds & Lowe, P.C.

(57) ABSTRACT

A device for the heat treatment of a product includes an enclosure, a conveyor for transporting the product between an inlet of the enclosure and an outlet of the enclosure, which comprise a screw mounted in such a way as to rotate in the enclosure according to a geometric rotational axis, and a heater for heating the screw by Joule effect. The screw has an electrical resistance that varies along the geometric rotational axis.

17 Claims, 4 Drawing Sheets

(51) Int. Cl.
*F26B 17/20* (2006.01)
*F27B 9/36* (2006.01)
*F27D 11/02* (2006.01)

(52) U.S. Cl.
CPC ..... *F27D 11/02* (2013.01); *F26B 2200/02* (2013.01); *F27B 2009/2484* (2013.01)

(58) Field of Classification Search
USPC .... 219/388; 34/63, 578, 580, 586, 588, 592, 34/593, 135, 137, 142, 147, 166, 179, 34/181, 182, 241, 201, 235, 236; 110/224, 227, 229, 257; 198/658, 570; 222/227, 252; 366/156.1, 133, 20, 318, 366/35, 38, 50, 79, 80, 81, 82, 83, 84, 85, 366/86, 87, 88, 89, 90, 147, 228; 426/32, 426/165, 473; 165/88, 120, DIG. 140
See application file for complete search history.

(56) References Cited

U.S. PATENT DOCUMENTS 2,491,210 A * 12/1949 Rennie ..... C22B 34/34 373/111
2,928,666 A * 3/1960 Distler ..... C21D 9/16 198/382
3,272,649 A * 9/1966 Huser ..... C13B 30/023 127/17
3,340,566 A * 9/1967 Woosley ..... B22F 1/0048 198/609
3,458,321 A * 7/1969 Stephenson ..... A23P 30/20 366/145
3,884,607 A * 5/1975 Gerhards ..... B29B 7/484 425/144
4,126,757 A * 11/1978 Smith, Jr. ..... H05B 3/64 219/406
4,249,032 A * 2/1981 Smith, Jr. ..... F27B 5/14 219/406
4,540,592 A * 9/1985 Myer ..... A23L 7/109 426/451
4,730,937 A * 3/1988 Hehl ..... B29C 45/74 366/146
4,950,870 A * 8/1990 Mitsuhashi ..... G05D 23/22 219/390
4,960,043 A * 10/1990 van Lengerich ..... A21C 1/065 366/291
4,993,943 A * 2/1991 Norris ..... B09C 1/06 110/224
5,143,626 A * 9/1992 Nugent ..... A61L 11/00 210/748.08
5,165,432 A * 11/1992 McKibben ..... B08B 3/041 134/107
5,549,383 A * 8/1996 Knoll ..... H05B 3/42 366/149
5,842,782 A * 12/1998 Lau ..... B29B 7/485 366/85
5,869,810 A * 2/1999 Reynolds ..... F27B 9/062 219/388
6,035,546 A * 3/2000 Stricker ..... B01J 8/10 34/147
6,375,345 B1 * 4/2002 Lepez ..... H05B 3/40 219/209
7,531,255 B2 * 5/2009 Nomura ..... B01J 19/0093 219/504
2008/0136066 A1 * 6/2008 Taylor ..... H05B 6/107 264/486
2008/0295356 A1 * 12/2008 Nickerson ..... F26B 17/18 34/519
2009/0175119 A1 * 7/2009 Wenger ..... B29B 7/481 366/132
2009/0280449 A1 * 11/2009 Dungey ..... C21D 9/0037 432/11
2010/0051233 A1 * 3/2010 Whitney ..... F26B 3/24 165/87
2012/0024687 A1 * 2/2012 Bratina ..... B01D 1/223 201/33

FOREIGN PATENT DOCUMENTS

FR 2 924 300 A1 5/2009
WO WO 95/11416 A1 4/1995
WO WO 2009095564 A2 * 8/2009 ..... C10B 7/10

* cited by examiner

DEVICE FOR THE HEAT TREATMENT OF A PRODUCT

The invention relates to a device for performing heat treatment on a substance such as a biomass, a polymer material, or any other divided solid. It should be recalled that the term "biomass" designates the biodegradable fractions of substances, waste, and residues coming from industry in general and from agriculture, from sylviculture, and from associated industries, in particular.

TECHNOLOGICAL BACKGROUND OF THE INVENTION

Numerous industrial fields have recourse to polymer materials for creating their products, such as plastics materials. In the present context of recycling waste, there is therefore a need for recycling industrial waste and in particular polymer waste.

It is thus known to recycle such waste by subjecting it to various chemical and/or heat treatments.

For example, a heat treatment device is known that comprises an enclosure, means for conveying the substance between the inlet of the enclosure and the outlet of the enclosure, which means comprise a screw mounted to rotate inside the enclosure about an axis of rotation, and means for driving the screw in rotation. The device also has heater means for heating the screw by the Joule effect.

Waste is usually inserted in the inlet of the enclosure in the form of divided solids that are raw or of divided solids that have been preconditioned, e.g. by a densification step.

The screw pushes the granules continuously towards the outlet of the enclosure. Because of the temperature of the screw, the granules soften progressively inside the enclosure until they melt. The granules as melted in this way can then be prepared in order to be reused, thus enabling treated waste to be recycled.

Nevertheless, such devices are not adapted to treating certain materials. In particular, certain kinds of plastics material waste reach their melting temperature very slowly and therefore melt only belatedly after entering into the enclosure.

OBJECT OF THE INVENTION

An object of the invention is to propose a heat treatment device that can be adapted to treating a greater number of substances.

BRIEF DESCRIPTION OF THE INVENTION

In order to achieve this object, the invention provides a device for applying heat treatment to a substance, the device comprising an enclosure, conveyor means for conveying the substance between an inlet of the enclosure and an outlet of the enclosure, the means for conveying the substance comprising a screw mounted to rotate inside the enclosure about an axis of rotation and having drive means for driving the screw in rotation, and heater means for heating the screw by the Joule effect.

According to the invention, the screw presents electrical resistance that varies along the axis of rotation.

By causing the resistance of the screw to vary in accordance with the invention, it is possible to adapt the resistance of the screw as a function of a temperature profile that is to be generated in the enclosure. In particular, the screw may be configured so as to generate a temperature profile inside the enclosure that matches the treatment to be performed on the substance being conveyed.

In prior art treatment devices, the screw is identical along its entire length. In the absence of any substance to be conveyed inside the enclosure and ignoring heat losses by convection at the inlet and at the outlet of the enclosure, the temperature reached by each unit length of the screw is therefore identical. In the presence of a substance to be conveyed inside the enclosure and ignoring said heat loses by convection, the temperature difference between the screw and the substance is greater at the inlet of the enclosure than at the outlet of the enclosure, since transfers of heat by conduction take place between each unit length of the screw and the substance being conveyed, thereby leading to the temperature of the substance being raised progressively. From a thermodynamic point of view, less and less energy is transferred to the substance as it travels along the enclosure.

Thus, in a first embodiment, the resistance may be adapted so that, while no substance is being conveyed, the temperature of the screw at the outlet from the enclosure is higher than at the inlet of the enclosure, such that, while substance is being conveyed by the screw, the temperature difference between the substance and the screw remains substantially constant all along the transit of the substance through the enclosure. That increases the effectiveness with which heat is transferred and therefore enhances the heat treatment of certain substances, such as biomasses.

In a second embodiment, the resistance of the screw may be adapted so that, while no substance is being conveyed, the temperature of the screw at the inlet of the enclosure is higher than at the outlet of the enclosure, such that, while substance is being conveyed by the screw, the temperature of the screw remains substantially higher than the melting temperature of the substance. It is found in prior art devices that introducing divided solids of plastics material cools down the screw. At the inlet of the enclosure, the screw can thus present a temperature lower than the melting temperature of the divided solids, so that they do not melt immediately. It is thus necessary to wait for the divided solids to be conveyed over a certain distance before they begin to melt. In this second embodiment, it is possible to arrange for the temperature of the screw at the inlet of the enclosure to be higher than the melting temperature of the plastics material when it is inserted into the enclosure. The divided solids thus melt much more quickly, thereby enhancing their heat treatment.

The treatment device of the invention can thus be adapted to treating a larger number of substances than can prior art devices.

BRIEF DESCRIPTION OF THE DRAWINGS

The invention can be better understood in the light of the following description of a non-limiting embodiment of the invention given with reference to the accompanying figures, in which.

DETAILED DESCRIPTION OF THE INVENTION

Figure 1:
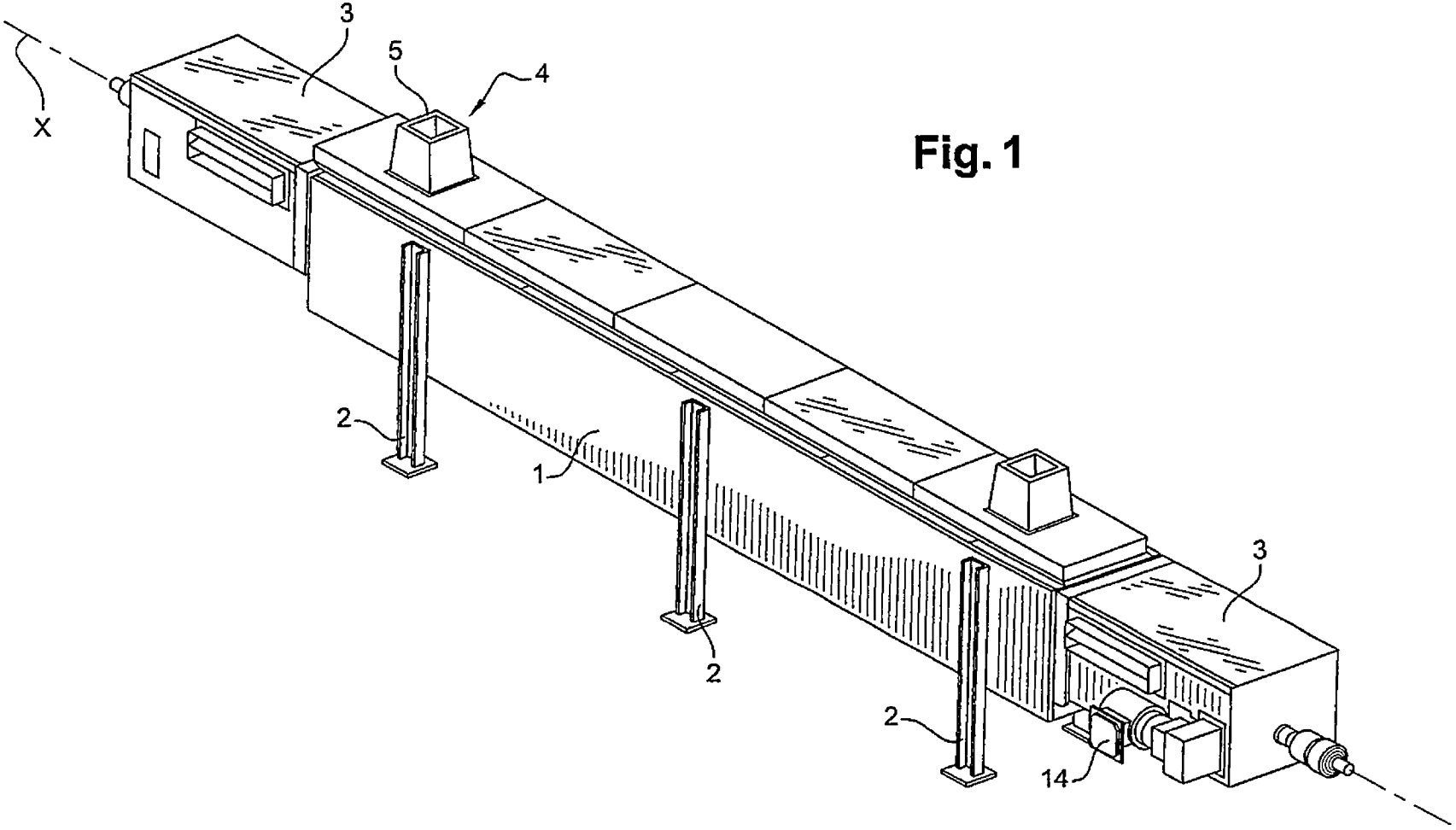
FIG. 1 is a perspective view of a treatment device in a first embodiment of the invention.
Figure 2:
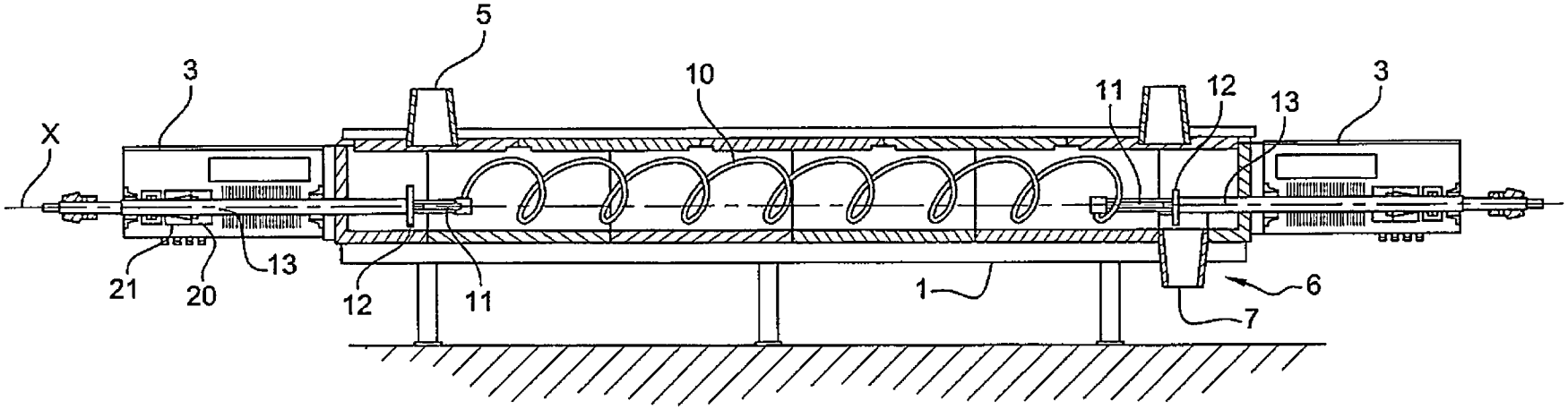
FIG. 2 is a section view of FIG. 1.

With reference to FIGS. 1 and 2, the device constituting a first embodiment of the invention serves to apply heat treatment to a substance. For this purpose, the device of the invention comprises an enclosure 1 extending essentially in a horizontal direction and held at a distance from the ground by legs 2. The enclosure 1 comprises an outer casing, in a single piece in this example, e.g. made of metal, and in particular made of non-magnetic stainless steel. In a particular embodiment, the enclosure 1 also includes an inner casing made as a single piece of refractory material. Respective equipment boxes 3 are attached to each of the ends of the enclosure 1.

In this example, the enclosure 1 has an inlet 4 arranged through the cover of the enclosure 1 substantially at a first end of the enclosure 1. In a particular embodiment, the device has an inlet chimney 5 that is connected in leaktight manner to the inlet 4 of the enclosure. By way of example, the inlet chimney 5 is connected to a device for grinding, compacting, or granulating the substance in question so as to present it as divided solids, or indeed it is connected to a device for preconditioning the substance in question, which is already in the form of divided solids. A preconditioning device serves to heat and dry said substance to set temperature and relative humidity values or to densify the substance. The divided solids are two-dimensional granules in the form of flakes or else they are three-dimensional granules.

The enclosure 1 also includes an outlet 6 that in this example is formed in the bottom of the enclosure 1 substantially at the second of the two ends of the enclosure 1. In a particular embodiment, the device has an outlet chimney 7 that is connected in leaktight manner to the outlet 6 of the enclosure 1. By way of example, the outlet chimney 7 is connected to a device for cooling the substance.

Naturally, the bottom and the cover of the enclosure 1 are defined relative to the ground on which the enclosure 1 is standing.

As can be seen more clearly in FIG. 2, the device has means for conveying the substance between an inlet of the enclosure and an outlet of the enclosure. These means thus comprise a screw 10 that extends inside the enclosure 1 along an axis X between the two equipment boxes 3 and that is mounted to rotate about said axis X inside the enclosure 1. By way of example, the screw 10 may be made of stainless steel. Specifically, the screw 10 is in the form of a helical coil that is fastened end-on at each of its two ends to respective shaft segments 11; the fastening being by welding, for example. Each of said shaft segments 11 is connected at its other end via a respective flange 12 to a shaft 13 on the same axis that passes through the associated end equipment box.

The conveyor means also include means for driving the screw 10 to rotate about the axis X, which means are arranged in one of the equipment boxes 3. According to a particular aspect of the invention, the rotary drive means comprise an electric motor 14 and mechanical connection means between the outlet shaft of the motor and one end of the associated same-axis shaft 13, the shaft 13 itself driving the screw 10. These rotary drive means in this example include control means for controlling the speed of rotation of the outlet shaft of the motor, which means may for example comprise a variable speed controller. The control means thus enable the speed of rotation of the screw 10 to be adapted to the substance it is conveying, i.e. they enable the transit time of the substance through the enclosure 1 to be varied adapted.

The control device also includes heater means for heating the screw 10 by the Joule effect, which heater means are arranged in the equipment boxes 3 in this example. In a particular embodiment, the heater means comprise generator means for generating electricity and means for connecting the two ends of the screw to the two polarizers of said generator means. For this purpose, each same-axis shaft 13 is securely connected to a coaxial drum 20 of electrically conductive material with carbon brushes 21 rubbing thereagainst to deliver electricity, which brushes are connected by conductor wires (not shown) to generator means for generating electricity. The screw 10 thus carries the same electric current all along the axis X. In a particular aspect of the invention, the heater means comprise means for regulating the electric current carried by the screw 10. In this example the regulator means comprise a power controller interposed between the electricity generator means and the connection means. The regulator means thus enable the electric current carried by the screw 10 to be adapted to the substance being conveyed.

In operation, the substance for treatment is introduced via the inlet chimney 5 in the form of raw divided solids or preconditioned divided solids, and the screw 10 pushes the divided solids continuously towards the outlet 6 of the enclosure 1. Because of the temperature of the screw 10, the divided solids soften progressively until they melt. The screw 10 thus serves to perform heat treatment on the substance and to convey the substance.

For further details, reference may be made to Document FR 2 924 300 in the name of the Applicant, in which the enclosure 1, the conveyor means, and the heater means are described in detail.

Figure 3:
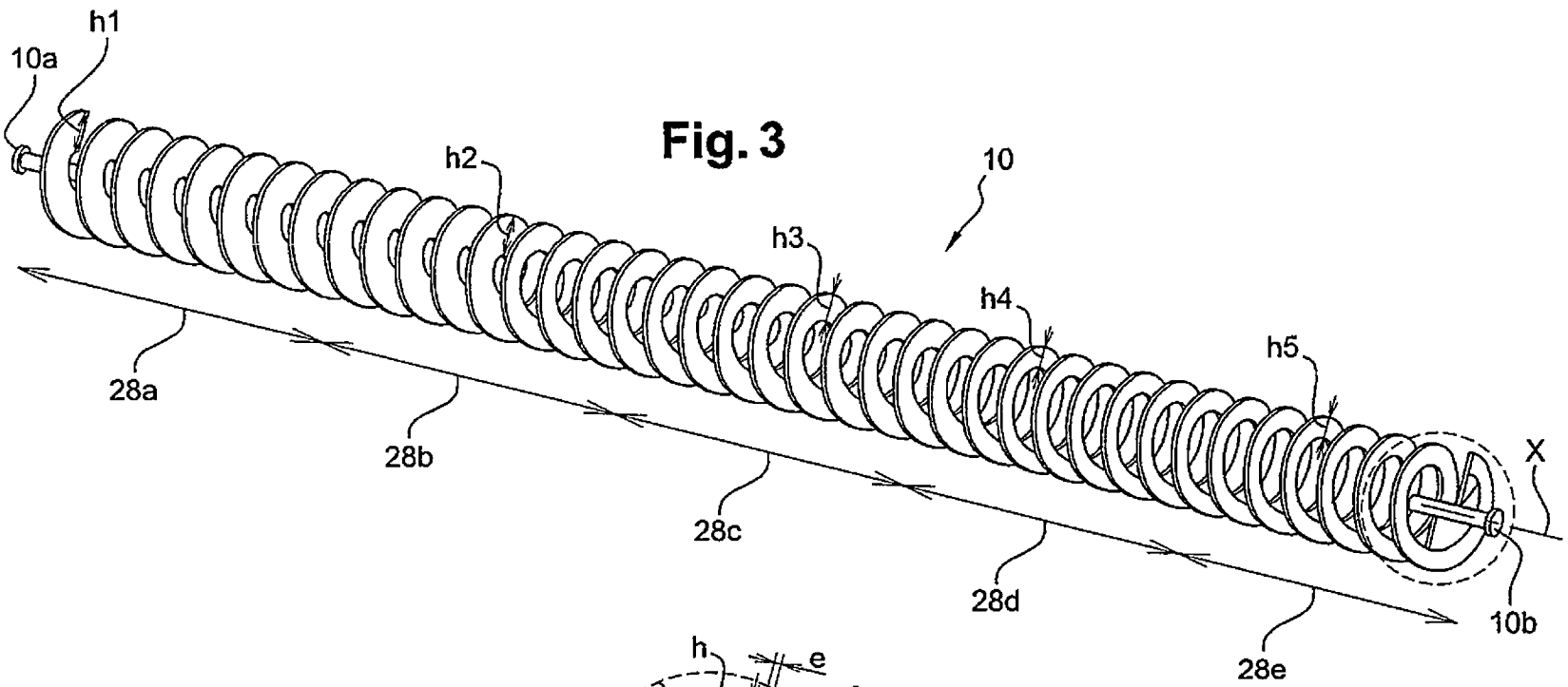
FIG. 3 is a diagrammatic perspective view of a screw of the treatment device shown in FIG. 1.
Figure 4:
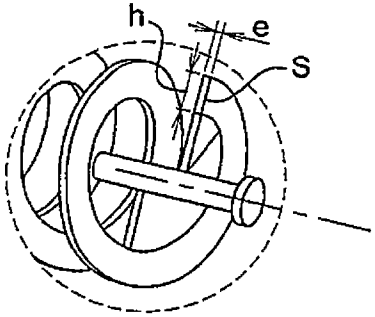
FIG. 4 is an enlarged view of a portion of FIG. 3.

With reference to FIGS. 2 and 3, the screw 10 in this example comprises screw flights that are "flat", each screw flight presenting a rectangular section of area S (shown in FIG. 4). The area S is defined by multiplying the thickness e of the screw flight (thickness defined along the axis X) by the height h of the screw flight (height defined in a direction perpendicular to the axis X).

In an advantageous embodiment, the screw 10 is subdivided along the axis X into five successive portions 28*a*, 28*b*, 28*c*, 28*d*, and 28*e* presenting distinct electrical resistances. The first portion 28*a* extends along the axis X between the first end of the screw 10*a* that is situated substantially at the inlet chimney 5, to the beginning of the second portion 28*b*. The second portion 28*b* extends along the axis X between the end of the first portion 28*a* and the beginning of the third portion 28*c*. The fifth and last portion 28*e* extends along the axis X between the end of the fourth portion 28*d* and the second end of the screw 10*b* that is situated substantially at the outlet chimney 7. Naturally, the five portions are secured to one another.

In an advantageous embodiment of the invention, each portion of the screw has screw flights of a height different from the height of the other portions, the screw flights all being identical to one another within a given portion. Thus, each portion of the screw has an electrical resistance that is different from the resistance of each of the other portions. The resistance of a screw flight may be defined as follows:

$$R = \rho \frac{\ell}{S}$$

where:

ρ is the electrical resistivity of the material of the screw flight in ohm·mm$^2$/m (where mm$^2$ is square millimeters and m is meters);

l is the length of the screw flight in meters; and

S is the area of the screw flight in square meters.

By modifying the height of a screw flight, the area of the screw flight is modified so that the resistance of the screw flight is changed. Since the resistance of a portion is proportional to the resistance of its screw flights, this serves to modify the resistance of a portion.

More precisely, and in a first embodiment of the invention, the first portion 28*a* has a first screw flight height $h_1$, the second portion 28*b* has a second screw flight height $h_2$ that is less than the first screw flight height $h_1$, the third portion 28*c* has a third screw flight height $h_3$ that is less than the second screw flight height $h_2$, the fourth portion 28*d* has a fourth screw flight height $h_4$ that is less than the third screw flight height $h_3$, and the fifth portion 28*e* has a fifth screw flight height $h_5$ that is less than the fourth screw flight height $h_4$. The resistance of the screw 10 thus increases along the axis X on going from the inlet 4 of the enclosure to the outlet 6 of the enclosure. As a result, when no substance is being conveyed and the screw 10 is carrying an electric current, the temperature of the screw 10 in the first portion 28*a* is lower than the temperature in the second portion 28*b* which in screw flight is lower than the temperature in the third portion 28*c*, itself lower than the temperature in the fourth portion 28*d*, which is itself lower than the temperature in the fifth portion 28*e*.

Figure 5:
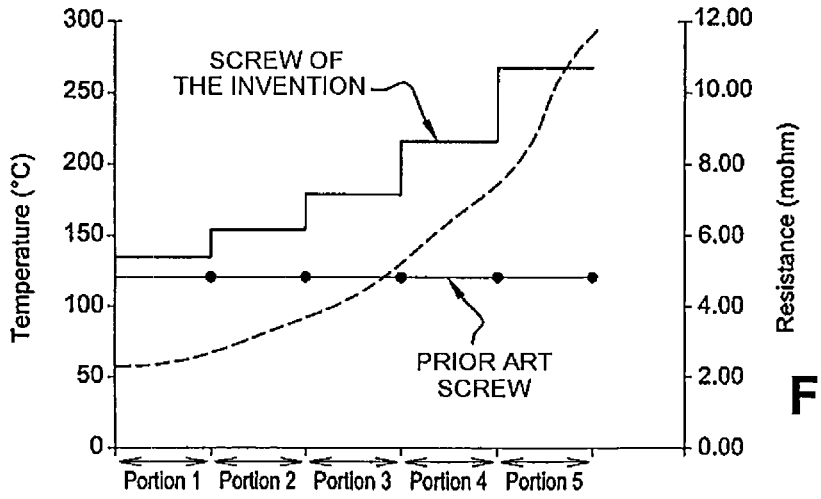
FIG. 5 is a graph showing a temperature profile of the screw shown in FIG. 3 together with a resistance profile associated with said screw, and also a temperature profile of a prior art screw.

FIG. 5 thus shows the temperature profile of the screw 10 once the screw 10 has been heated to reach steady conditions and without any substance being conveyed by the screw 10 (profile represented by the dashed-line curve). The resistance profile of the screw 10 is represented by the continuous-line curve. FIG. 5 also shows a temperature profile for a prior art screw of resistance that is constant along the axis of rotation of the screw once the screw has been heated to reach steady conditions and without any substance being conveyed by the screw (profile represented by the continuous-line curve with squares).

The temperature profile of the screw 10 shows clearly that the temperature is higher at the outlet 6 of the enclosure 1 than the temperature at the inlet of the enclosure 1. Such a temperature profile is particularly adapted to applying heat treatment to a biomass.

In a second embodiment of the invention, the device is identical to the device of the first embodiment of the invention except that the resistance of the screw decreases along the axis X between the inlet of the enclosure and the outlet of the enclosure.

Figure 6:
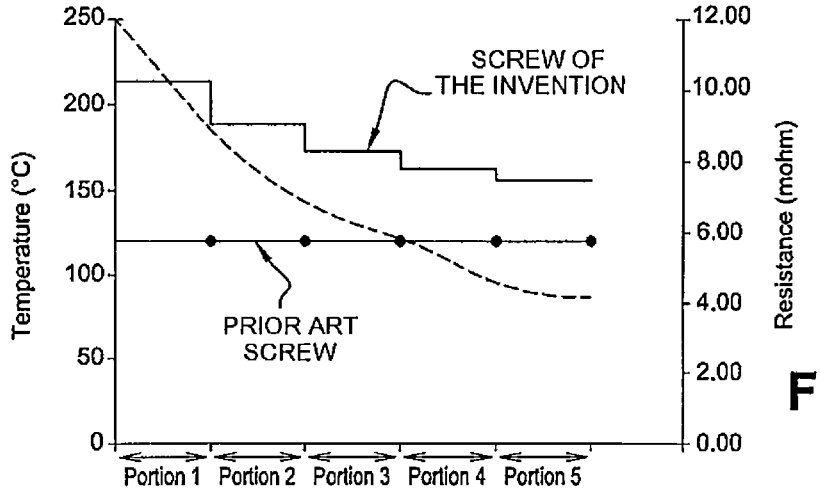
FIG. 6 is a graph showing a temperature profile of a screw of a treatment device in a second embodiment of the invention together with a resistance profile associated with said screw, and also a temperature profile of a prior art screw.

FIG. 6 thus shows the temperature profile of the screw in the second embodiment of the invention once the screw has been heated up to steady conditions and without any substance being conveyed by the screw (profile represented by the dashed-line curve). The resistance profile of the screw is represented by the continuous-line curve. FIG. 6 also shows the temperature profile of a prior art screw having constant resistance along the axis of rotation of the screw, as it exists once the screw has been heated to reach steady conditions and without any substance being conveyed by the screw (profile represented by the continuous-line curve with squares).

The temperature profile of the screw of the invention shows clearly that the temperature at the outlet from the enclosure is much lower than the temperature at the inlet to the enclosure. Such a temperature profile is particularly well adapted to applying heat treatment to a plastics material.

In preferred manner, the resistance of the screw in the second embodiment is adapted so that when the screw is conveying a substance, the temperature of the screw remains substantially constant and above the melting temperature of the substance over the entire length of the screw. The substance is then a plastics material.

Figure 7:
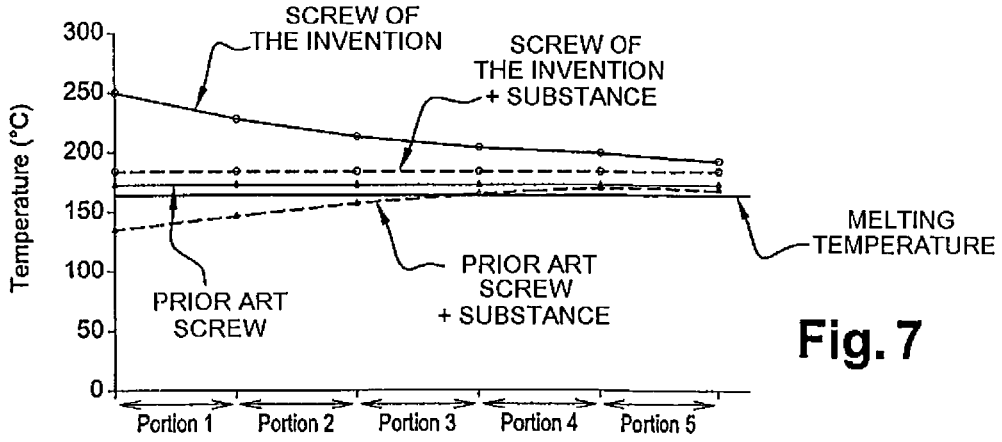
FIG. 7 is a graph showing the temperature of a screw of a treatment device in a second embodiment of the invention, a temperature profile of said screw while it is conveying a substance, and also a temperature profile of a prior art screw and a temperature profile of the prior art screw while it is conveying a substance.

FIG. 7 thus shows the temperature profile of the screw as adapted in this way once steady conditions have been reached and without the plastics material being conveyed by the screw (profile represented by the continuous-line curve with squares) and the temperature profile of the same screw while it is conveying the plastics material (profile represented by the dashed-line curve together with squares). There can also be seen the temperature profile of a prior art screw after reaching steady conditions and without the plastics material being conveyed by the prior art screw (profile shown by the continuous-line curve with triangles), and the temperature profile of the same prior art screw while conveying the plastics material (profile represented by the dashed-line curve with triangles).

It can thus be seen both for the screw of the invention and for the prior art screw that inserting plastics material via the inlet of the enclosure causes the screw to cool down.

With the prior art screw, the screw presents an inlet temperature lower than the melting temperature of the plastics material (shown by the continuous-line curve) such that the plastics material does not melt immediately. It is therefore necessary, in this example, to wait for the plastics material to be conveyed over more than half the length of the prior art screw before it begins to melt.

In contrast, for the screw of the invention, the screw remains at a temperature that is higher than the melting temperature of the plastics material along the entire length of the screw. In particular, the temperature of the screw at the inlet to the enclosure remains higher than the melting temperature of the plastics material when it is inserted into the enclosure. The plastics material in question thus melts much more quickly with the screw of the invention than with the prior art screw, thereby improving its heat treatment.

The device of the invention may be adapted to applying heat temperature to a wide range of substances mainly by the way in which the screw 10 is defined. In addition, once the screw 10 is in place inside the enclosure 1, it is also possible to a smaller extent to adapt the heat treatment of the substance being conveyed by modulating the electric current conveyed by the screw 10 and by modulating the speed of rotation of the screw 10.

Naturally, the invention is not limited to the embodiments described and it is possible to apply variant embodiments thereto without going beyond the ambit of the invention as defined by the claims.

The number of portions specified is not limiting. Furthermore, the screw need not be divided into portions and it may present electrical resistance that varies continuously along the axis X. For example, each screw flight of the screw may have a different section, such that the resistance of the screw increases progressively from one end of the screw to the other.

Although the resistance of the screw in this example increases or decreases between the inlet of the enclosure and the outlet of the enclosure, the screw could include at least one portion of lower resistance (or of greater resistance) than the two portions on either side thereof.

Although the resistance of the screw in this example is modified along the axis X by varying the height of the screw flights in each portion, it is possible to act on other parameters. For example, the screw may have screw flights of sections that differ from one portion to another, by means of differing thicknesses, of differing thicknesses and heights, and/or of differing lengths. The portions may themselves be of differing lengths. The portions may be made of different materials. The portions may have screw flights at differing pitches. The weights of the portions may be different. Naturally, it is possible to act on several parameters at the same time in order to modify the electrical resistance of the screw along the axis X.

The way the screw is defined may also be associated with additional parameters other than the electrical resistance of the screw.

For example, the definition of the screw may take into consideration the fact that the volume of the substance to be treated varies little or not at all within the enclosure (e.g. when merely pasteurizing a substance), or that the volume of the substance for treatment varies within the enclosure (e.g. when pyrolyzing substances such as biomasses, which can lead to gas being formed that modifies the volume of the biomass).

It should be recalled that the interstitial volume is defined by the following formula:

$$V_{interstitial}=S_m*(P-e)$$

where:

$S_m$ is the wetted surface area or the surface area of the screw flight in contact with the substance, which area is proportional to the effective height of substance between each of the screw flights;

e is the thickness of the screw flight; and

P is the pitch of the screw.

When the substance is subject to little or no variation in volume, the interstitial volume between the screw flights is preferably kept constant all along the axis X. By way of example, action may then be taken on the thickness of the screw flights while keeping the height of the screw flights constant so as to vary the resistance of the screw along the axis X, the pitch of the screw being adjusted a little so as to keep the interstitial volume constant.

When the substance is subject to volume variation, the filling factor of the screw decreases between the inlet of the enclosure and the outlet of the enclosure. In a preferred embodiment, the interstitial volume of the screw is then caused to decrease between the inlet of the enclosure and the outlet of the enclosure so as to conserve a constant filling factor along the axis X of the screw. For example, it is possible to act on the thickness e of a screw flight and on the pitch P of the screw while keeping the height h of a screw flight constant so as to vary both the resistance of the screw and the interstitial volume.

The way the screw is defined may also take into consideration the heat exchange area between the substance and the screw. It is preferable to seek to maximize this heat exchange area by having a screw pitch P that is as small as possible, a screw flight height h that is as large as possible, and a filling factor of the screw that is as large as possible.

In any event, when defining the screw in order to cause the electrical resistance of the screw to vary along the axis X, it should be ensured that the geometrical parameters that are used for the screw flights (section, height, thickness, . . . ) and for the screw (pitch, length, diameter, . . . ) also define mechanical strength for the screw that is sufficient for conveying the substance in question.

The invention claimed is:

1. A device for applying heat treatment to a substance, the device comprising:

an enclosure;

a conveyor for conveying the substance between an inlet of the enclosure and an outlet of the enclosure, the conveyor comprising a screw mounted to be driven in order to rotate inside the enclosure about an axis of rotation, the screw being subdivided into at least two portions in the axis of rotation, the at least two portions have equal lengths; and a heater that passes electric current through the screw for heating the screw by a Joule effect;

wherein electrical resistance of one of the at least two portions of the screw is higher than electrical resistance of another one of the at least two portions of the screw such that temperature of the screw changes along the axis of rotation.

2. The device according to claim 1, wherein the screw has flat screw flights.

3. The device according to claim 1, wherein the screw comprises screw flights that present distinct sections in each of the portions.

4. The device according to claim 3, wherein the screw flights present distinct heights and thicknesses in each of the portions.

5. The device according to claim 3, wherein the screw flights present distinct heights or thicknesses in each of the portions.

6. The device according to claim 1, wherein a pitch of the screw varies from said one of the at least two portions to said another one of the at least two portions.

7. The device according to claim 1, wherein the electrical resistance of the screw increases between the inlet of the enclosure and the outlet of the enclosure.

8. The device according to claim 1, wherein the electrical resistance of the screw decreases between the inlet of the enclosure and the outlet of the enclosure.

9. The device according to claim 1, wherein the screw is also configured so that an interstitial volume of the screw varies along the axis of rotation.

10. The device according to claim 1, wherein the screw is also configured in such a manner that an interstitial volume of the screw remains constant along the axis of rotation.

11. The device according to claim 1, wherein each of the at least two portions of the screw has a distinct geometrical parameter or is made of a distinct material.

12. A device for applying heat treatment to a substance, the device comprising:

an enclosure;

a conveyor for conveying the substance between an inlet of the enclosure and an outlet of the enclosure, the conveyor comprising a screw mounted to be driven in order to rotate inside the enclosure about an axis of rotation, the screw being subdivided into at least two portions in the axis of rotation, the at least two portions have equal lengths; and a heater that passes electric current through the screw for heating the screw by a Joule effect;

wherein electrical resistance of one of the at least two portions of the screw is higher than electrical resistance of another one of the at least two portions of the screw such that temperature of the screw changes along the axis of rotation and a center of the screw is devoid along a central axis.

13. The device according to claim 12, wherein each of the at least two portions of the screw has a distinct geometrical parameter or is made of a distinct material.

14. A device for applying heat treatment to a substance, the device comprising:

an enclosure;

a conveyor extending from an inlet to an outlet of the enclosure for conveying the substance between the inlet of the enclosure and the outlet of the enclosure, the conveyor comprising a screw mounted to be driven in order to rotate inside the enclosure about an axis of rotation, the screw being subdivided into at least two portions in the axis of rotation, the at least two portions have equal lengths; and a heater that passes electric current through the screw for heating the screw by a Joule effect;

wherein electrical resistance of one of the at least two portions of the screw is higher than electrical resistance of another one of the at least two portions of the screw such that temperature of the screw changes along the axis of rotation.

15. The device according to claim 14, wherein each of the at least two portions of the screw has a distinct geometrical parameter or is made of a distinct material.

16. A device for applying heat treatment to a substance, the device comprising:

an enclosure;

a conveyor extending from an inlet to an outlet of the enclosure for conveying the substance between the inlet of the enclosure and the outlet of the enclosure, the conveyor comprising a screw mounted to be driven in order to rotate inside the enclosure about an axis of rotation, the screw being subdivided into at least two portions in the axis of rotation, the at least two portions have equal lengths; and a heater that passes electric current through the screw for heating the screw by a Joule effect;

wherein electrical resistance of one of the at least two portions of the screw is higher than electrical resistance of another one of the at least two portions of the screw such that temperature of the screw changes along the axis of rotation and a center of the screw is devoid along a central axis.

17. The device according to claim 16, wherein each of the at least two portions of the screw has a distinct geometrical parameter or is made of a distinct material.

* * * * *